US009545706B2

(12) United States Patent
Ou

(10) Patent No.: US 9,545,706 B2
(45) **Date of Patent: *Jan. 17, 2017**

(54) TOOL SUSPENSION DEVICE

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/004,995

(22) Filed: Jan. 24, 2016

(65) Prior Publication Data

US 2016/0136791 A1 May 19, 2016

Related U.S. Application Data

(63) Continuation-in-part of application No. 14/097,088, filed on Dec. 4, 2013, now abandoned.

(51) Int. Cl.

| | |
|---|---|
| ***B65D 85/28*** | (2006.01) |
| ***B25B 13/56*** | (2006.01) |
| ***B25H 3/00*** | (2006.01) |
| ***B25B 15/00*** | (2006.01) |

(52) U.S. Cl.
CPC ..... *B25B 13/56* (2013.01); *B25B 15/008* (2013.01); *B25H 3/003* (2013.01)

(58) Field of Classification Search
CPC ..... B25H 3/003; B25H 3/02; B25H 3/023; B25H 3/04; B25H 3/06; B65D 85/28; B25B 13/56; B25B 15/008
USPC ..... 206/349, 372–37, 38, 234
See application file for complete search history.

(56) References Cited

U.S. PATENT DOCUMENTS

| | | | | |
|---|---|---|---|---|
| 2,305,021 | A | 12/1942 | Meier | |
| 5,918,741 | A * | 7/1999 | Vasudeva | B25H 3/003 206/234 |
| 6,068,123 | A * | 5/2000 | Chen | B25H 3/028 206/373 |
| 7,264,118 | B2 * | 9/2007 | Chen | B25H 3/023 206/372 |
| 2004/0035748 | A1 * | 2/2004 | Hernandez, Jr. | B25H 3/023 206/748 |
| 2005/0269340 | A1 | 12/2005 | Chuan | |
| 2006/0260963 | A1 * | 11/2006 | Ke | B25H 3/023 206/349 |
| 2015/0034515 | A1 * | 2/2015 | Monyak | E21C 35/183 206/349 |

FOREIGN PATENT DOCUMENTS

| | | |
|---|---|---|
| TW | 198269 | 1/1993 |

* cited by examiner

*Primary Examiner* — Jacob K Ackun
*Assistant Examiner* — Rafael Ortiz
(74) *Attorney, Agent, or Firm* — Muncy, Geissler, Olds & Lowe, P.C.

(57) ABSTRACT

A tool suspension device includes a suspension member, a first and a second receiving members. The suspension member is protrudedly formed with a first and a second pivot structures at two ends. The suspension member has a suspension portion for suspension. The first and the second receiving members are pivotably connected with the first and the second pivot structures respectively. Thus, the first receiving member and the second receiving member are able to be piled together for storing. Also, the first and the second receiving members are able to pivot to be unfolded for available of tools for a user.

3 Claims, 6 Drawing Sheets

TOOL SUSPENSION DEVICE

FIELD OF THE INVENTION

The present invention is a CIP of application Ser. No. 14/097,088, filed Dec. 4, 2013, the entire contents of which are hereby incorporated by reference.

BACKGROUND OF THE INVENTION

Description of the Prior Art

A conventional suspension member for tools, as disclosed in patent TW 198269, having a plurality of a plurality of partition plates in a seat, and distance between any two adjacent partition plates varies so that a tool can be positioned between two partition plates. Thereafter, the seat is closed by a cover. However, number of tools which are able to be received is too low. In addition, the size of the suspension member is too big for taking. On the other hand, to get the tools, the cover has to be removed in advance. Thus, convention suspension members for tools are not convenient to use.

SUMMARY OF THE INVENTION

The main object of the present invention is to provide a tool suspension device easy for storage and convenient for users to take the tools.

To achieve the above and other objects, a tool suspension device of the present invention includes a suspension member, a first receiving member, and a second receiving member.

The suspension member has a first face and an opposite second face. The suspension member is formed with a first pivot structure and a second pivot structure which are protruded from the first face and extend away from the second face. The first pivot structure and the second pivot structure are located at two opposite ends of a same side of the suspension member respectively. The first pivot structure is defined with a first pivot axis, and the second pivot structure is defined with a second pivot axis. A plane defined by the first pivot axis and the second pivot axis nonoverlaps over the suspension member and is at a predetermined distance from the first face. The suspension member has a suspension portion at an end for suspension.

The first receiving member is connected with the first pivot structure. The first receiving member is pivotable with respect to the suspension member around the first pivot axis via the first pivot structure. The first receiving member is adapted for receiving at least one tool.

The second receiving member is connected with the second pivot structure. The second receiving member is pivotable with respect to the suspension member around the second pivot axis via the second pivot structure. The second receiving member is adapted for receiving at least one tool. The first receiving member and the second receiving member are able to be piled together.

Thereby, both the first and the second receiving members are able to receive tools, and the first and the second receiving members are able to pivot due to the first pivot structure and the second pivot structure so that the first and the second receiving members are able to be piled up together. Thus, the size of the suspension device of the present invention is minimized, and maximum amount of tools can be received in the suspension device of the present invention. In addition, when the first and the second receiving members are pivoted to move apart, the received tools are easier to take for users.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
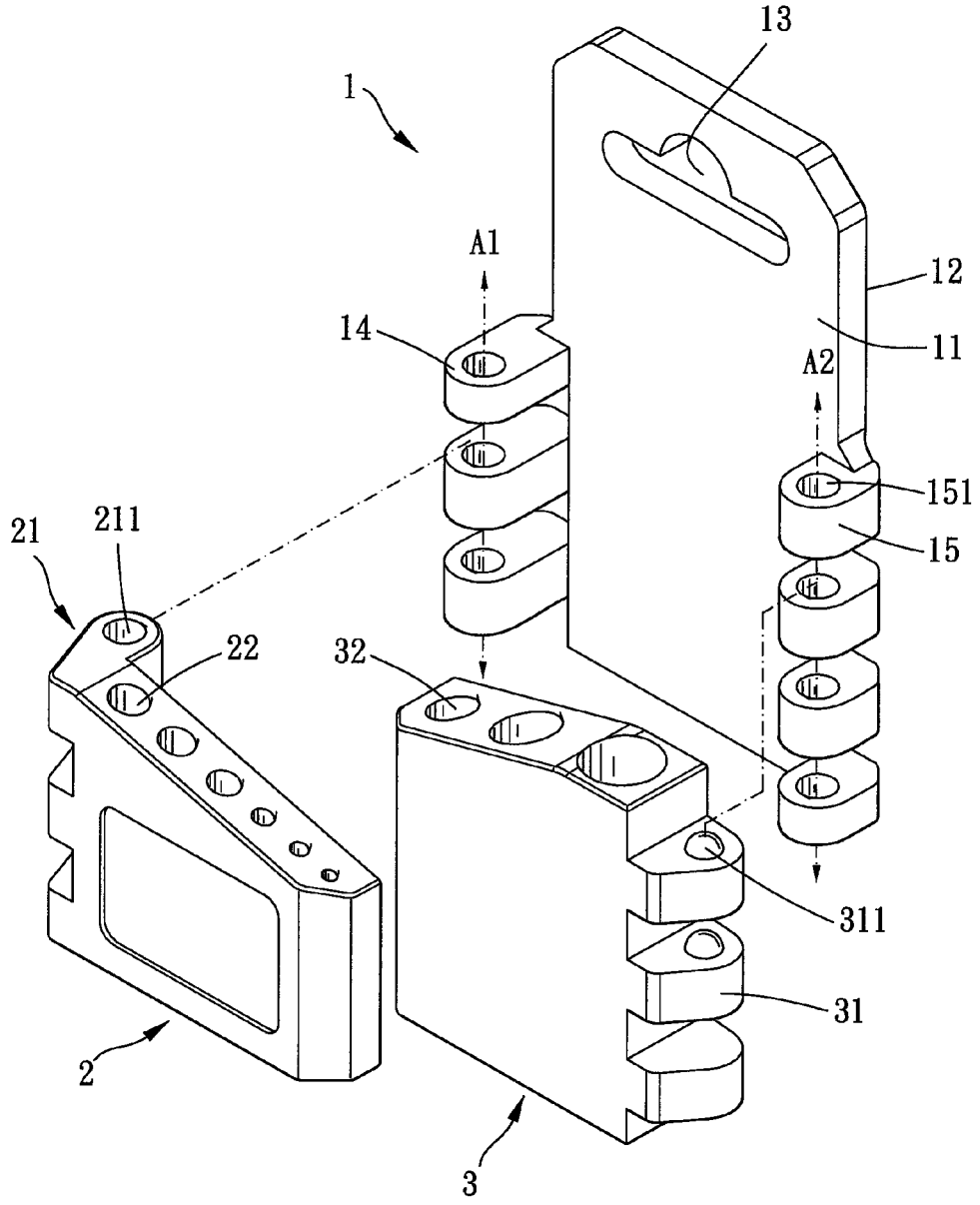
FIG. 1 is a stereogram of the present invention.

Please refer to FIG. 1 to FIG. 5 for a major embodiment of the present invention. The suspension device of the present invention includes a suspension member 1, a first receiving member 2, and a second receiving member 3.

The suspension member 1 has a first face 11 and an opposite second face 12. The suspension member 1 is formed with a first pivot structure and a second pivot structure which are protruded from the first face away from the second face. In the present embodiment, the suspension member 1 is plate-shaped, and the suspension member 1 is formed with a suspension portion 13 for suspension. Preferably, the suspension portion 13 is an elongated hole for being suspended on a hook or other device. Optionally, the suspension portion can be a hook or similar device. The first pivot structure and the second structure are located at two opposite ends of a same side of the suspension member 1 respectively. The first pivot structure is defined with a first pivot axis A1, and the second pivot structure is defined with a second pivot axis A2. Preferably, the first pivot axis A1 and the second pivot axis A2 are parallel to each other. A plane defined by the first pivot axis A1 and the second pivot axis A2 do not overlap the suspension member 1 and is at a predetermined distance from the first face 11 of the suspension member 1. More preferably, a distance from the first pivot axis A1 to the first face 11 of the suspension member 1 is larger than a distance from the second pivot axis A2 to the first face 11 of the suspension member 1 so as to allow the first receiving member 2 and the second receiving member 3 to be piled up together.

In the present embodiment, the first pivot structure includes a plurality of first pivot members 14. Each first pivot member 14 is protruded from the first face 11 away from the second face 12. The first pivot members 14 are spacedly arranged along the first pivot axis A1. The second pivot structure includes a plurality of second pivot members 15. Each second pivot member 15 is protruded from the first face 11 away from the second face 12. The second pivot members 15 are spacedly arranged along the second pivot axis A2. Preferably, the first pivot members 14, the second pivot members 15, and the suspension member 1 are formed as a single piece. A receiving space is defined between the first pivot members 14, the second pivot members 15, and the suspension member 1. In the preferred embodiment, the first pivot members 14, the second pivot members 15, and the suspension member 1 are formed by plastic injection molding.

Figure 5:
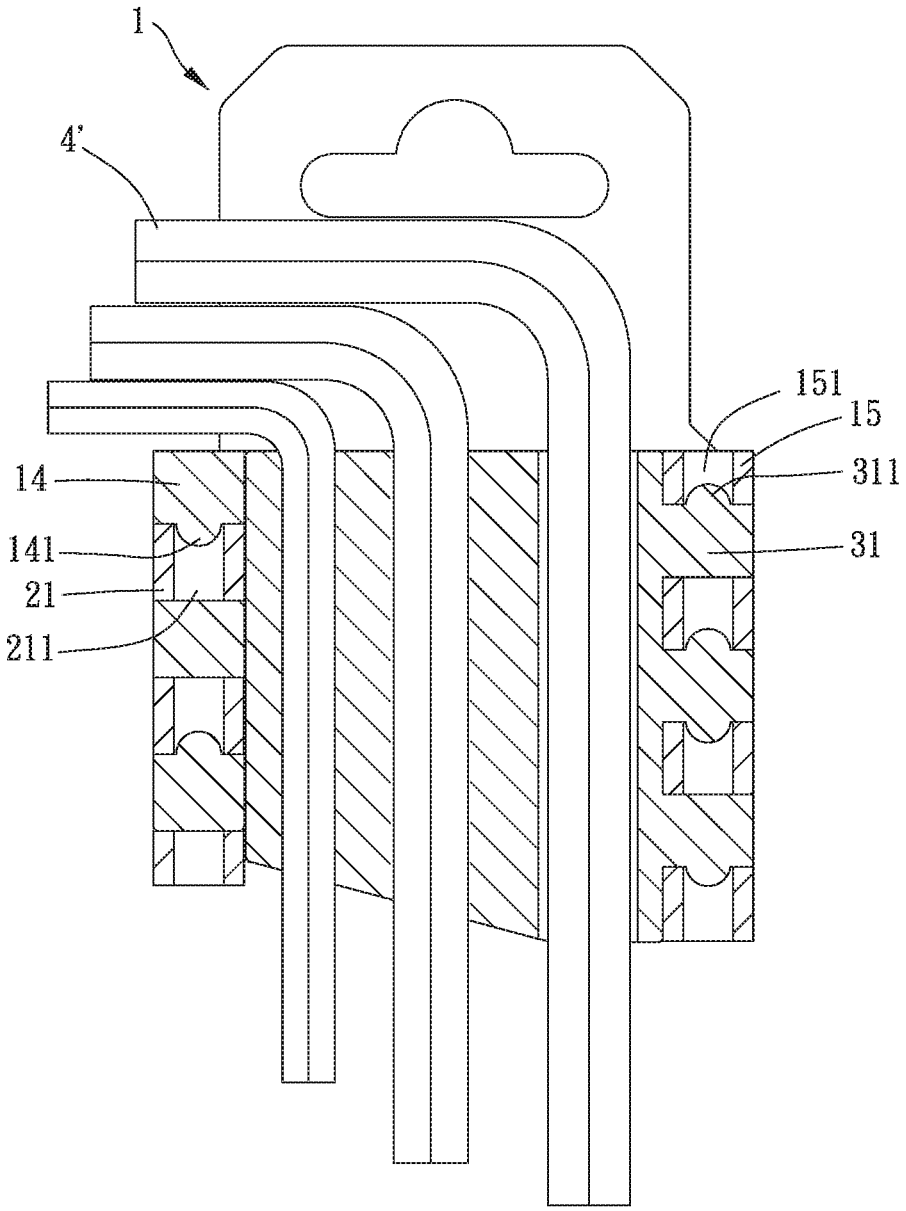
FIG. 5 is a profile of the present invention.

The first receiving member 2 is connected with the first pivot structure of the suspension member 1, and the first receiving member 2 is pivotable with respect to the suspension member 1 by the first pivot structure along the first pivot axis A1. Preferably, the first receiving member 2 has a plurality of first connecting portions 21. Each first connecting portion 21 is protruded from a face of the first receiving member 2 perpendicularly. The first receiving member 2 is pivotably disposed on the first pivot members 14 of the first pivot structure by the first connecting portions 21 so that the first pivot members 14 and the first connecting portions 21 are alternatively arranged along the first pivot axis A1. Specifically, one of each first pivot member 14 and each first connecting portion 21 is formed with a protrusion, and the other one of each first pivot member 14 and each first connecting portion 21 is formed with a positioning hole. The protrusion is received in the positioning hole. In the present embodiment, a face of each first pivot member 14 facing an adjacent first connecting portion 21 is formed with the protrusion 141 (as shown in FIG. 5), and each first connecting portion 21 is formed with the positioning hole 211. Thereby, the rotatable connection between the protrusions and the positioning holes allows the first receiving member 2 to pivot with respect to the suspension member 1 around the first pivot axis A1. The first receiving member 2 is adapted for receiving at least one tool 4, such as a hexagonal wrench. Specifically, the first receiving member 2 is formed with a plurality of receiving holes 22 extending parallely to the first pivot axis A1. Each receiving hole 22 is adapted for a tool 4 to insert in. Preferably, the diameters of the receiving holes 22 vary for receiving tools in different sizes.

The second receiving member 3 is connected to the second pivot structure of the suspension member 1. The second receiving member 3 is pivotable with respect to the suspension member around the second pivot axis A2. Preferably, the second receiving member 3 has a plurality of second connecting portions 31. Each second connecting portion 31 is protruded from a face of the second receiving member 3. The second receiving member 3 is pivotably disposed on the second pivot members 15 by the second connecting portions 31 so that the second pivot members 15 and the connecting portions 31 are alternatively arranged along the second pivot axis A2. Specifically, one of each second pivot member 15 and each second connecting portion 31 is formed with a protrusion, and the other one of each second pivot member 15 and each second connecting portion 31 is formed with positioning hole. The protrusion is received in the positioning hole. In the present embodiment, each second pivot member 15 is formed with the positioning hole 151 parallelly to the second pivot axis A2. A face of each second connecting portion 31 facing an adjacent second pivot member 15 is formed with the protrusion 311. Due to the rotatable connection between the protrusion 311 and the positioning hole 151, the second receiving member 3 is pivotable with respect to the suspension member 1 around the second pivot axis A2. Thereby, the first receiving member 2 and the second receiving member 3 are able to be pivot around the first pivot axis A1 and the second pivot axis A2 respectively to be piled up together in the receiving space, and the first receiving member 2 and the second receiving member 3 partially overlap. The second receiving member 3 is adapted for receive at least one tool 4'. Specifically, the second receiving member 3 is formed with a plurality of receiving holes 32 extending parallely to the second pivot axis A2. Each receiving hole 32 is adapted for a tool 4' to insert in. Preferably, diameters of the receiving holes 32 vary for receiving tools 4' in different sizes.

Figure 6:
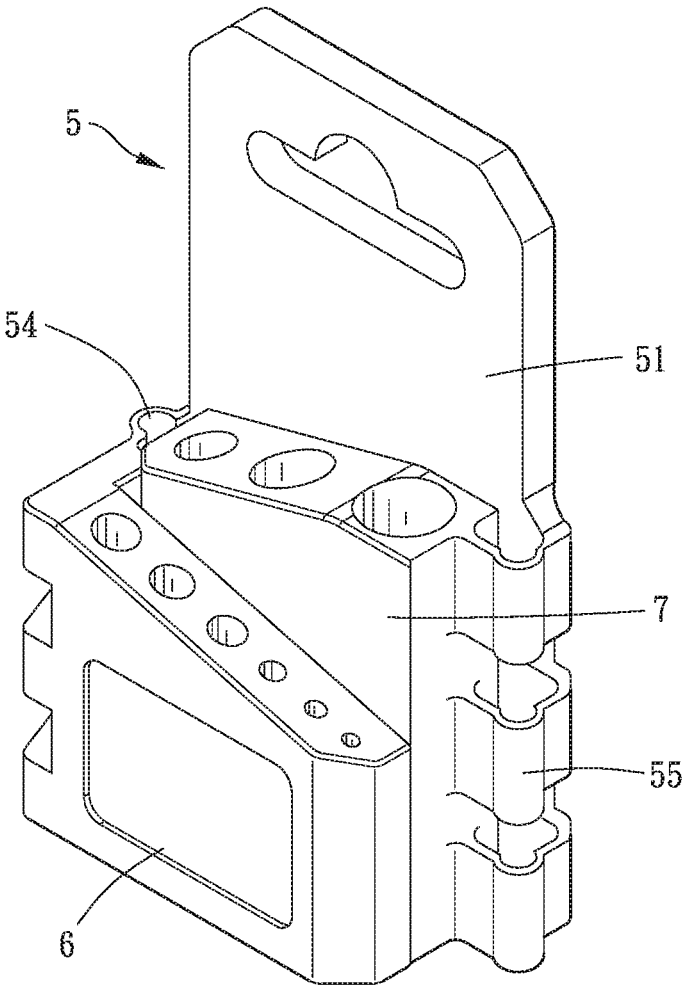
FIG. 6 is a stereogram showing a second embodiment of the present invention.

Please refer to FIG. 6 for another embodiment. The first pivot structure includes at least one first pivot ear 54. More preferably, the first pivot structure includes a plurality of pivot ears 54 spacedly arranged along the first pivot axis A1. Two ends of each first pivot ear 54 are connected with the first face 51 of the suspension member 5 so that the first pivot ears 54, the suspension member 5, and the first receiving member 6 are formed in a single piece. The first pivot ears 54 are bent-shaped and are made of plastic so as to have elasticity. Thus, the first receiving member 6 is able to pivot with respect to the first pivot axis A1. Preferably, the first pivot ears 54, the suspension member 5, and the first receiving member 6 are formed as a single piece by plastic injection molding so that time of manufacture is reduced.

Similarly, the second pivot structure includes at least one second pivot ear 55. Preferably, the second pivot structure includes a plurality of second ears 55 spacedly arranged along the second pivot axis A2. Two ends of each second pivot ear 55 are connected with the first face 51 of the suspension member 5 and the second receiving member 7 so that the second pivot ears 55, the suspension member 5, and the second receiving member 7 are formed integrally. Each second pivot ear 55 is bent-shaped and is made of plastic so as to have elasticity. Thus, the second receiving member 6 is able to pivot with respect to the suspension member 5 around the second pivot axis A2. That is to say, the first receiving member 6, the suspension member 5, and the second receiving member 7 are formed integrally. Preferably, the first receiving member 6, the suspension member 5, and the second receiving member 7 are formed as a single piece by plastic injection molding.

Figure 2:
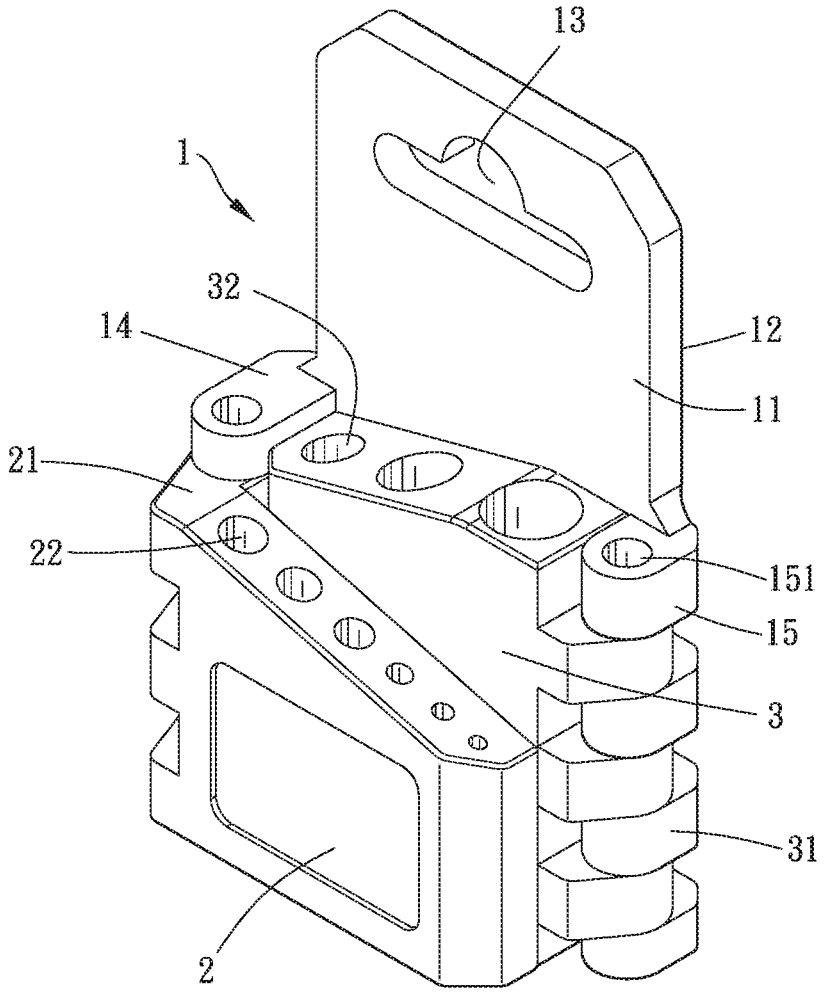
FIG. 2 is an illustration of the present invention showing that the first and the second receiving members are piled up together.
Figure 3:
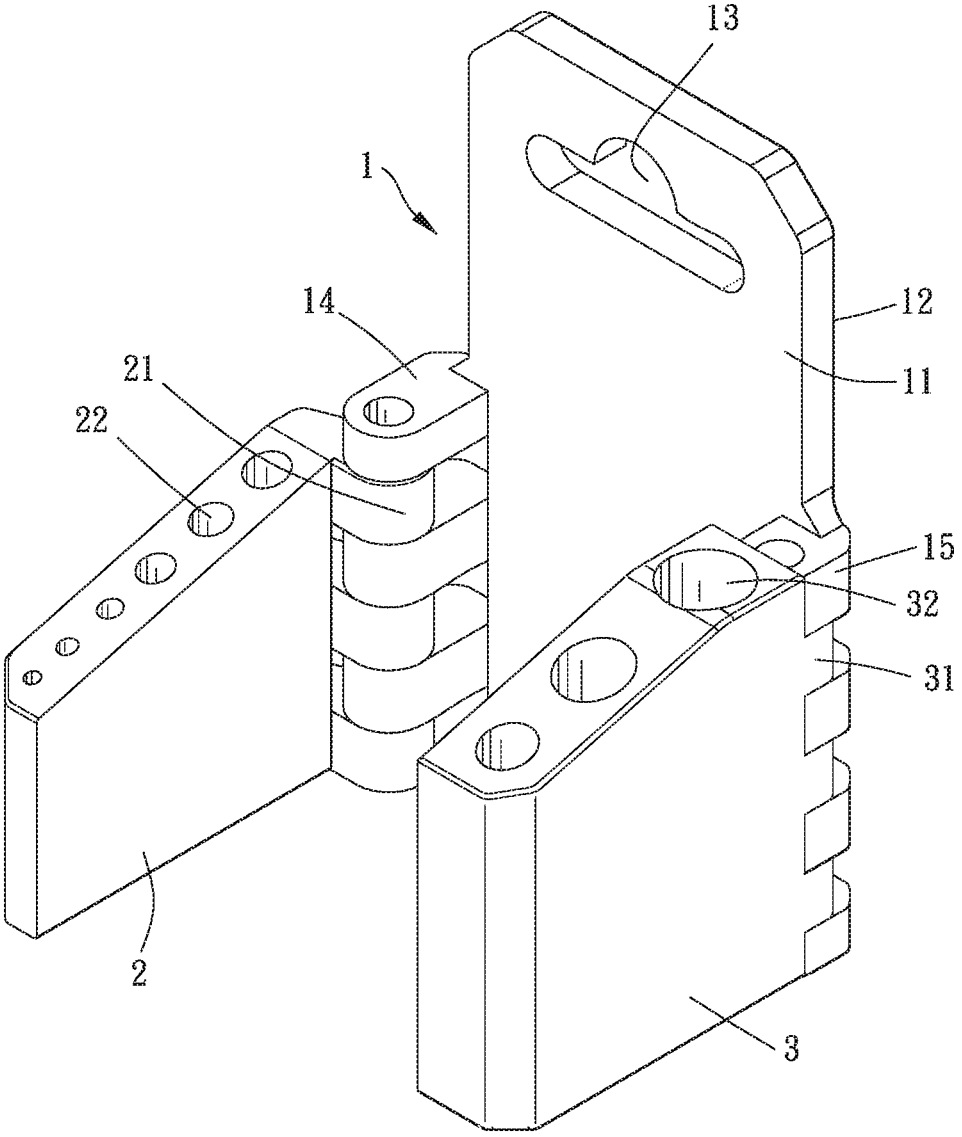
FIG. 3 is an illustration of the present invention showing that the first and the second receiving members are pivoted apart.
Figure 4:
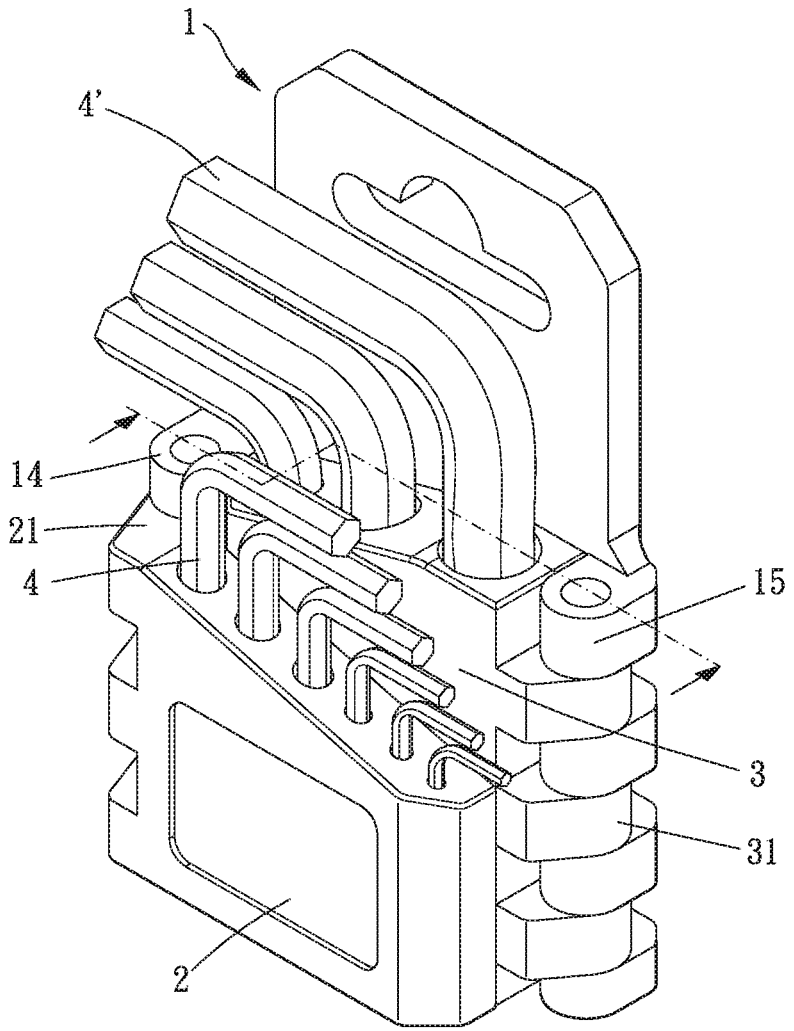
FIG. 4 is an illustration of the present invention.

In view of the first embodiment of the present invention, please refer to FIGS. 1 and 2. A first direction is defined perpendicular to the first face 11 of the suspension member 1. Each first pivot member 14 or each second pivot member 15 has a first end and an opposite second end. The first end is connected with the first face 11 of the suspension member 1. A length of each first pivot member 14 is defined as a distance between the second end of the first pivot member 14 to the first face 11 of the suspension member 1 along the first direction. A length of each second pivot member 14 is defined as a distance between the second end of the second pivot member 14 to the first face 11 of the suspension member 1 along the first direction. The length of each first pivot member 14 is larger than the length of each second pivot member 15. Thereby, when the first receiving member 2 and the second receiving member 3 are pivoted toward each other and are piled up together in the receiving space, the first receiving member 2 and the second receiving member 3 overlap each other along the first direction. That is, the second receiving member 3 is closer to the suspension member 1, and the first receiving member 2 is more distant from the suspension member 1.

Specifically, the first receiving member 2 is defined with a front face, a rear face, and a top face which is located between the front face and the rear face. The second receiving member 3 is also defined with a front face, a rear face, and a top face which is located between the front face and the rear face. When the first receiving member 2 and the second receiving member 3 are piled up together, the rear faces of the first receiving member 2 and the second receiving member 3 face the first face of the suspension member 1. The top faces of the first receiving member 2 and the second receiving member 3 are formed with the receiving holes 22 and 32, respectively. The top face of the first receiving member 2 is lower than the top face of the second receiving member 3 so that the top faces of the first receiving member 2 and the second receiving member 3 form a stepped face.

In use, please refer to FIGS. 2 to 5. The first receiving member 2 and the second receiving member 3 are both able to receive tools 4, 4'. Because the length of the first pivot member 14 is larger than the length of the second pivot member 15, so the first receiving member 2 and the second receiving member 3 are able to be piled up together to save space. When taking the tools 4, 4' for use, a user can open the first receiving member 2 and the second receiving member 3 by pivoting the first receiving member 2 and the second receiving member 3. On the other hand, the protrusions 141, 311 and the positioning holes 211, 151 make the manufacturing of the suspension device of the present invention easier.

What is claimed is:

1. A tool suspension device, including:

a suspension member, having a first face and an opposite second face, the suspension member being formed with a first pivot structure and a second pivot structure which are protruded from the first face and extend away from the second face, the first pivot structure and the second pivot structure being located at two opposite ends of a same side of the suspension member respectively, the first pivot structure being defined with a first pivot axis, the second pivot structure being defined with a second pivot axis, a plane defined by the first pivot axis and the second pivot axis nonoverlapping with the suspension member and being at a predetermined distance from the first face, a distance from the first pivot axis to the first face of the suspension member being larger than a distance from the second pivot axis to the first face of the suspension member, the suspension member having a suspension portion at an end for suspension;

a first receiving member, connected with the first pivot structure, the first receiving member being pivotable with respect to the suspension member around the first pivot axis via the first pivot structure, the first receiving member being adapted for receiving at least one tool; and a second receiving member, connected with the second pivot structure, the second receiving member being pivotable with respect to the suspension member around the second pivot axis via the second pivot structure, the second receiving member being adapted for receiving at least one tool, the first receiving member and the second receiving member being able to be piled up together;

wherein when the first receiving member and the second receiving member are piled up together, the second receiving member is sandwiched between the first receiving member and the suspension member;

wherein each of the first receiving member and the second receiving member is defined with a front face, a rear face, and a top face located between the front face and the rear face, the rear faces of the first receiving member and the second receiving member face the first face of the suspension member when the first receiving member and the second receiving member are piled up together, the top faces of the first receiving member and the second receiving member are formed with a plurality of receiving holes for receiving tools, the top face of the first receiving member is lower than the top face of the second receiving member so that the top faces of the first receiving member and the second receiving member form a stepped face;

wherein the first pivot structure includes a plurality of first pivot members, the first receiving member has a plurality of first connecting portions, the first pivot members and the first connecting portions are alternatively arranged along the first pivot axis, one of each first pivot member and each first connecting portion is formed with a protrusion, the other one of each first pivot member and each first connecting portion is formed with a positioning hole, the protrusion is rotatably received in the positioning hole;

wherein the second pivot structure includes a plurality of second pivot members, the second receiving member has a plurality of second connecting portions, the second pivot members and the second connecting portions are alternatively arranged along the second pivot axis, one of each second pivot member and each second connecting portion is formed with a protrusion, the other one of each second pivot member and each second connecting portion is formed with a positioning hole, the protrusion is rotatably received in the positioning hole;

wherein a first direction is defined perpendicular to the first face of the suspension member, each of the first pivot members and the second pivot members has a first end and a second end opposite to the first end, the first end of each of the first pivot members and the second pivot members is connected to the first face of the suspension member, a length of each first pivot member is defined as a distance between the second end of the first pivot member and the first face of the suspension member along the first direction, a length of each second pivot member is defined as a distance between the second end of the second pivot member and the first face of the suspension member along the first direction, the length of each first pivot member is larger than the length of the second pivot member.

2. The tool suspension device of claim 1, wherein the first pivot structure includes at least one first pivot ear, two ends of the first pivot ear are connected to the first face of the suspension member and the first receiving member respectively, the second pivot structure includes at least one second pivot ear, two ends of the second pivot ear are connected to the first face of the suspension member and the second receiving member respectively.

3. The tool suspension device of claim 2, wherein the first pivot structure includes a plurality of first pivot ears, the first pivot ears are spacedly arranged along the first pivot axis, the second pivot structure includes a plurality of second pivot ears, the second pivot ears are spacedly arranged along the second pivot axis.

* * * * *